US006007362A

United States Patent [19]

Davis et al.

[11] Patent Number: 6,007,362

[45] Date of Patent: Dec. 28, 1999

[54] ELECTRICAL CONNECTOR ASSEMBLY FOR A REFRIGERATOR DOOR

[75] Inventors: Wayne Samuel Davis, Harrisburg; Robert Neil Whiteman, Jr., Middletown, both of Pa.

[73] Assignee: The Whitaker Corporation, Wilmington, Del.

[21] Appl. No.: 08/987,629

[22] Filed: Dec. 9, 1997

[51] Int. Cl.[6] ..... H01R 13/627

[52] U.S. Cl. ..... 439/358; 439/680

[58] Field of Search ..... 439/357, 358, 439/680, 746, 747

[56] References Cited

U.S. PATENT DOCUMENTS

| | | | |
|---|---|---|---|
| 3,998,518 | 12/1976 | Mathe | 439/746 |
| 4,071,141 | 1/1978 | Bury et al. | 439/746 |
| 4,109,989 | 8/1978 | Snyder, Jr. et al. | 439/140 |
| 4,245,875 | 1/1981 | Shaffer et al. | 439/680 |
| 4,416,504 | 11/1983 | Sochor | 439/746 |
| 4,567,331 | 1/1986 | Coldren | 439/357 |
| 5,064,389 | 11/1991 | Klein et al. | 439/746 |
| 5,102,344 | 4/1992 | Tadokoro et al. | 439/98 |
| 5,115,562 | 5/1992 | Bowen et al. | 29/867 |
| 5,180,316 | 1/1993 | Miller et al. | 439/610 |
| 5,339,045 | 8/1994 | Yoneda et al. | 439/357 |
| 5,651,689 | 7/1997 | Plyler et al. | 439/357 |
| 5,690,501 | 11/1997 | Mader | 439/165 |
| 5,782,647 | 7/1998 | Okura et al. | 439/358 |

*Primary Examiner*—Neil Abrams
*Assistant Examiner*—Hae Moon Hyeon
*Attorney, Agent, or Firm*—Michael Asonoff

[57] ABSTRACT

An electrical connector assembly which includes a plug subassembly and a receptacle subassembly. The receptacle subassembly is substantially cylindrical with a diameter such that it passes through the hollow hinge pin of a refrigerator door. The receptacle body is formed with an outwardly extending abutment which is confined to the diametrical extremity of the cylinder and which cooperates with a latch member of the mating subassembly. The plug subassembly has a hollow forward mating portion for accepting the receptacle body therein. The forward mating portion is formed by an incomplete cylindrical wall having a longitudinal gap. The receptacle abutment is aligned with the gap and the plug latch member extends into the gap. Polarizing features are provided on both the plug and receptacle bodies to insure appropriate alignment of the plug and receptacle subassemblies.

9 Claims, 3 Drawing Sheets

ELECTRICAL CONNECTOR ASSEMBLY FOR A REFRIGERATOR DOOR

BACKGROUND OF THE INVENTION

This invention relates to the field of electrical connectors and, more particularly, to an electrical connector assembly particularly suitable for a refrigerator door.

The doors of present day refrigerators are more than mere closures for the interior of the refrigerator. Such doors are increasingly being equipped with electrical and electronic components such as, for example, control panels, ice dispensers, cold water taps, and the like. Accordingly, electrical cabling (i.e., a wire harness) must be provided to the door from the main body of the refrigerator in order to allow the transmission of electrical power and control signals between the door and the main body. For aesthetic and safety purposes, such cabling should not be allowed to loosely drape along its path of travel, but instead should be closely held. It is common to route such cabling, as part of its path of travel, through a hollow hinge pin of the refrigerator door. In the past, the cabling has been routed through the hinge pin and then a connector has been installed at the distal end of the cabling for subsequent engagement with a mating connector on cabling from the main refrigerator body. However, installing the connector at the end of the cabling during the final assembly of the refrigerator is not an easy task. It would therefore be desirable to provide a connector assembly which can be installed on cabling before the cabling is connected to various components within the refrigerator door and thereafter have the cabling, with the connector attached, installed through the hollow hinge pin for subsequent connection with a mating connector on cabling from the refrigerator body.

BRIEF DESCRIPTION OF THE INVENTION

In accordance with the principles of this invention, there is provided an electrical connector assembly which comprises a plug subassembly and a receptacle subassembly. The plug subassembly includes an insulative body which has a hollow forward mating portion bounded by an incomplete cylindrical wall to provide a gap in the wall. The plug body further has a contact receiving portion rearwardly of the gap which is a substantially solid partial cylinder with several contacts extending therethrough and which is coextensive with the cylindrical wall but subtends an arc less than the arc subtended by the cylindrical wall to provide a planar surface rearwardly of the gap and angularly symmetrical with respect to the gap. Finally, the plug subassembly includes a latch member mounted to the planar surface of the body. The latch member is pivotable about a pivot axis orthogonal to the axis of the plug body and has a forward end with a rear engagement wall extending into the gap. The receptacle subassembly includes an insulative body having a substantially cylindrical shape and sized so that a forward portion fits within the forward mating portion of the plug body with a like plurality of contacts extending therethrough. The diameter of the receptacle body is such that it can pass longitudinally through the hollow hinge pin of the refrigerator door. Finally, the receptacle subassembly has an abutment extending radially outward from a recess in the receptacle body forward portion, with the abutment being completely within the confines of the cylinder defining the outer wall of the receptacle body. The abutment extends into the gap of the plug body forward mating portion when the receptacle body forward portion is received in the plug body forward mating portion. A rear wall of the abutment is adapted for interfering engagement with the rear engagement wall of the plug latch member when the receptacle body forward portion is fully seated in the plug body forward mating portion.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
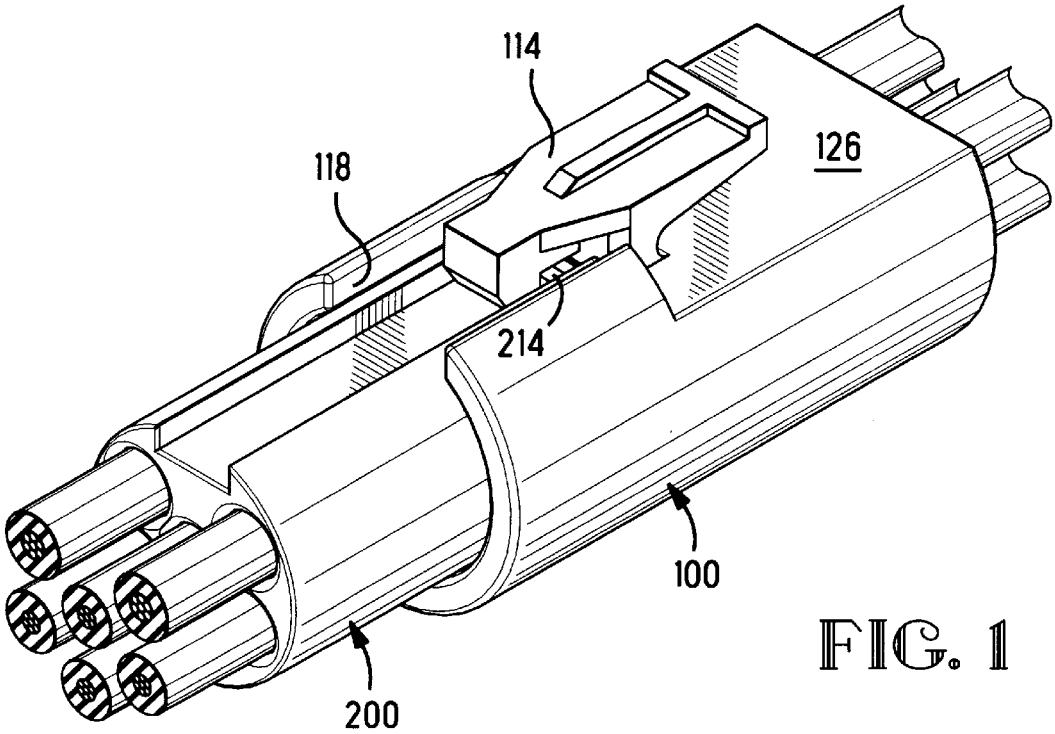
FIG. 1 is an isometric view of a mated electrical connector assembly according to the present invention.
Figure 6:
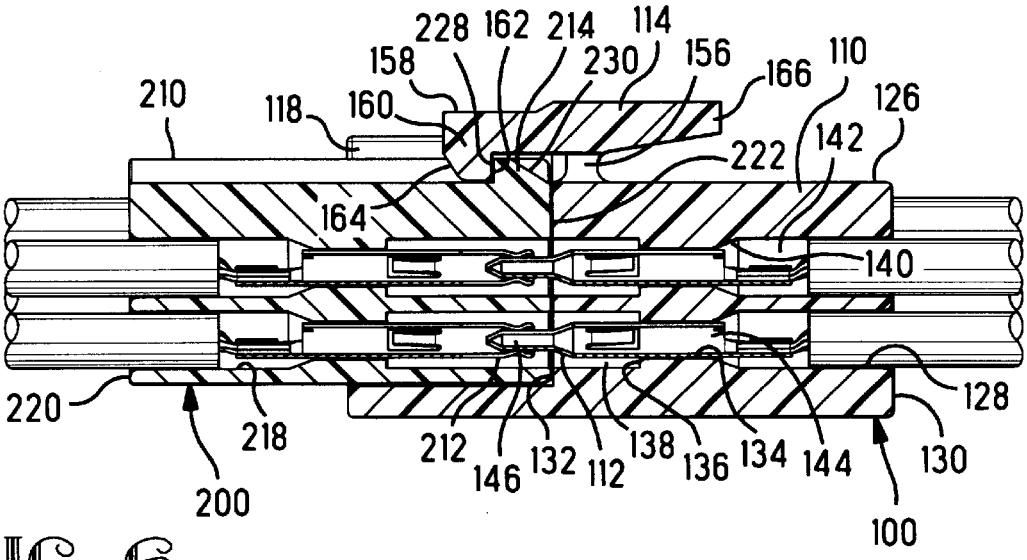
FIG. 6 is a longitudinal cross sectional view of the mated electrical connector assembly shown in FIG. 1.
Figures 2, 3:
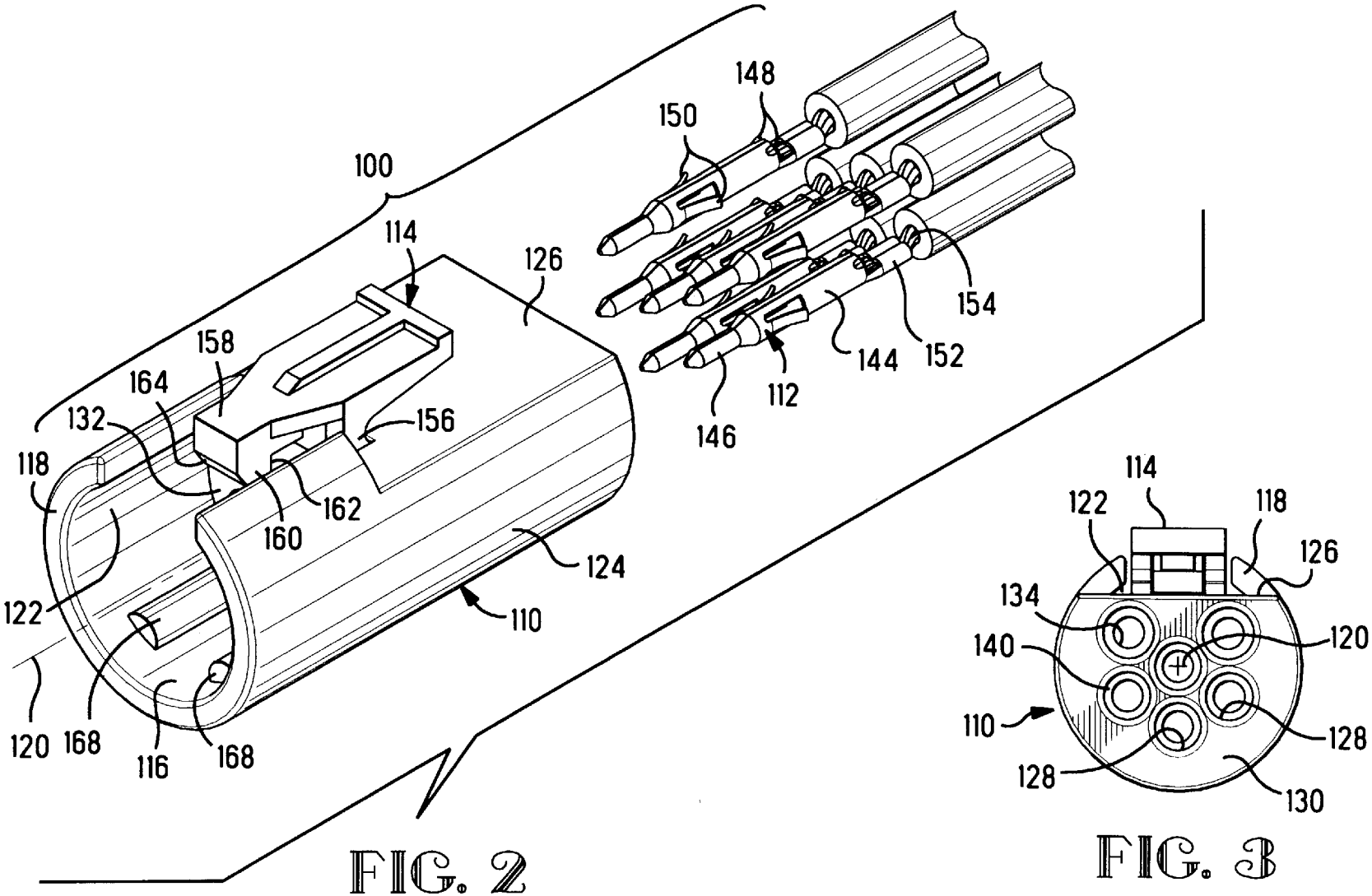
FIG. 2 is an exploded isometric view of the plug subassembly according to this invention.
FIG. 3 is a rear elevational view of the plug body.
Figures 4, 5:
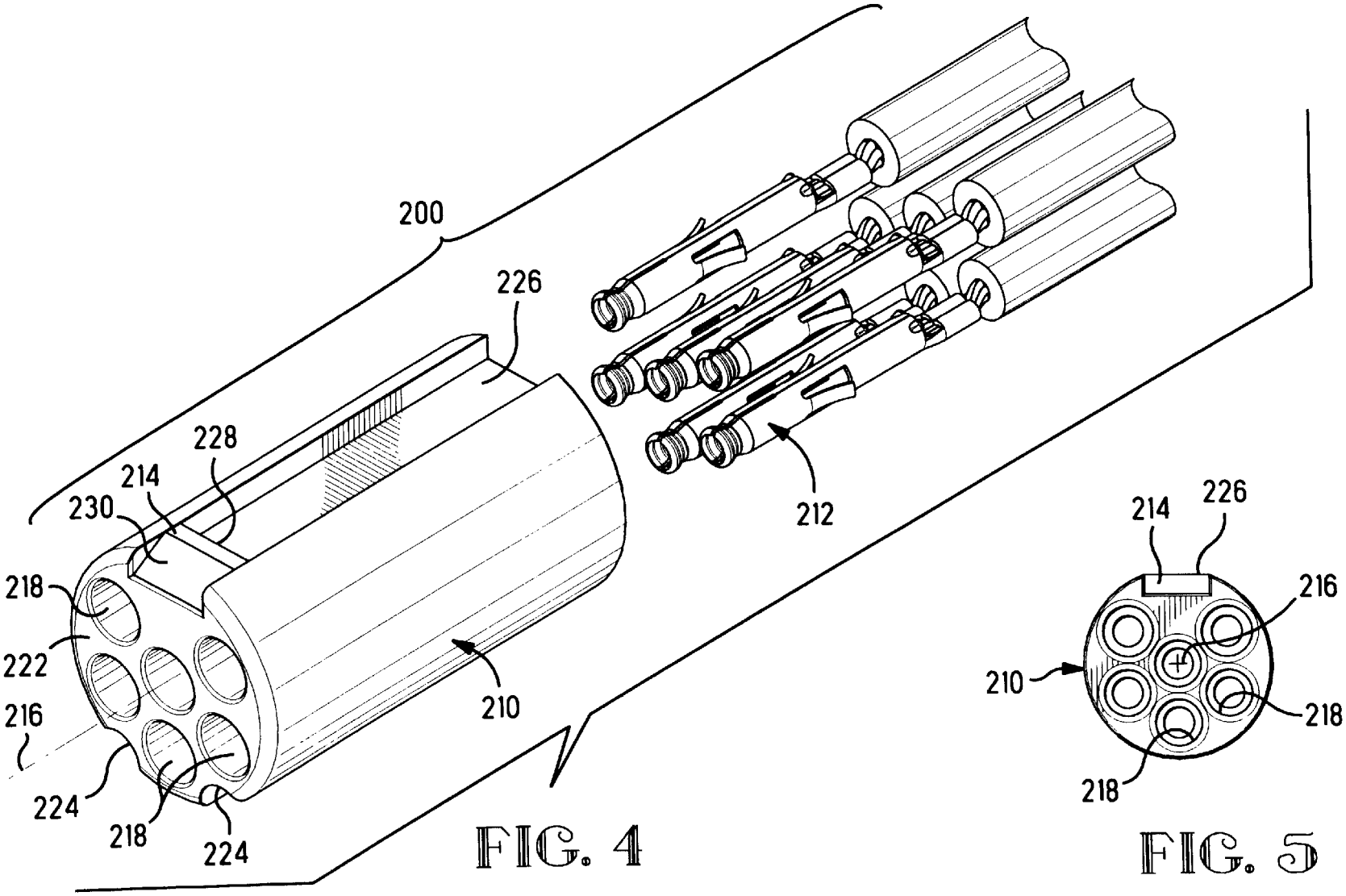
FIG. 4 is an exploded isometric view of the receptacle subassembly according to this invention.
FIG. 5 is a rear elevational view of the receptacle body.

Referring now to the drawings, FIG. 1 shows a plug subassembly, designated generally by the reference numeral 100, and a receptacle subassembly, designated generally by the reference numeral 200, in their mated and latched condition. As shown in FIG. 2, the plug subassembly 100 is made up of three major components—a plug body 110, at least one conductive male contact member 112, and a latch member 114. Similarly, the receptacle subassembly 200 is made up of three major components—a receptacle body 210, at least one conductive female contact member 212, and an abutment 214, as shown in FIG. 4.

The plug body 110 is molded of an insulative material and has a hollow forward mating portion 116 which is bounded by a cylindrical wall 118 defining a longitudinal axis 120, as best seen in FIG. 2. The wall 118 is incomplete, subtending an arc greater than 180° and less than 360° so that there is a gap 122 in the wall 118. The plug body 110 further has a contact receiving portion 124 rearwardly of the gap 122. The contact receiving portion 124 is a substantially solid partial cylinder which is coextensive with the cylindrical wall 118 but subtends an arc greater than 180° and less than the arc subtended by the cylindrical wall 118 to provide a planar surface 126 rearwardly of the gap 122 and which is angularly symmetrical about the axis 120 with respect to the gap 122, as best shown in FIG. 3. The contact receiving portion 124 is formed with a plurality of contact receiving bores 128 which extend longitudinally through the contact receiving portion 124 from a rear wall 130 to a front mating wall 132 which defines the rear of the forward mating portion 116. Each of the contact receiving bores 128 includes a central reduced diameter portion 134 which is terminated by a front wall 136 within an enlarged diameter forward portion 138 and a rear wall 140 within an enlarged diameter rear portion 142.

Each of the male contact members 112 is stamped and formed from conductive sheet stock to have a cylindrical barrel section 144 and a forward mating end 146. At the rear of the barrel section 146, there are at least two outwardly extending projections 148 and toward the forward end of the barrel section 144 there are at least two outwardly extending locking lances 150. Rearwardly of the barrel section 144 is a crimp section 152 for attaching the conductive wire, or wires, 154, as is conventional. Thus, when a contact member 112 is installed in a contact receiving bore 128, the lances 150 are compressed as they pass through the central reduced diameter portion 134 and then snap outwardly upon passing the front wall 136 and entering the enlarged diameter forward portion 138. The lances 150 thus interfere with subsequent rearward removal of the contact member 112 from the bore 128, by virtue of abutting against the front wall 136. The projections 148 are in interfering relation with the rear wall 140 to interfere with further forward movement of the contact member 112, thereby capturing the contact member 112 in the bore 128, with the forward mating end 146 of the contact member 112 extending beyond the front mating wall 132 into the forward mating portion 116.

The latch member 114 is preferably formed unitarily with the body 110 and includes a pedestal portion 156 extending radially outward from the surface 126. The pedestal portion 156 provides a pivot axis orthogonal to the plug axis 120. The latch member 114 further includes a forward end 158 which is cantilevered forwardly from the distal end of the pedestal portion 156. The forward end 158 is formed with a downwardly depending projection 160 having a rear engagement wall 162 which extends into the gap 122. The side walls 118 therefore provide protection for the latch member 114. The projection 160 is further formed with a forward camming surface 164, the function of which will be described in full detail hereinafter. Finally, the latch member 114 includes a handle portion 166 cantilevered rearwardly from the distal end of the pedestal portion 156. A downward force applied to the handle portion 166 results in the projection 160 being moved upwardly out of the gap 122, with the pedestal portion 156 providing a yieldable biasing force keeping the projection 160 in the gap 122 when no downward force is applied to the handle portion 166.

The receptacle body 210 is molded of an insulative material to have a substantially cylindrical shape defining a longitudinal axis 216 and sized so that a forward portion extending rearwardly from a front mating wall 222 fits within the hollow forward mating portion 116 of the plug body 110, as shown in FIG. 4. The receptacle body 210 is formed with a plurality of contact receiving bores 218 extending longitudinally therethrough from a rear wall 220 to the front mating wall 222. The contact receiving bores 218 in the receptacle body are aligned with the contact receiving bores 128 in the plug body. To insure such alignment, the receptacle body is formed with at least one longitudinal groove 224 extending rearwardly from the front mating wall 222 and which is complemental to a respective raised longitudinal rib 168 formed on the cylindrical wall 118 of the plug body 110. The angular locations of the ribs 168 and the grooves 124 are such as to provide a polarizing feature for the mating of the receptacle body 210 with the plug body 110. The contact receiving bores 218 in the receptacle body 210 are formed similarly to the contact receiving bores 128 in the plug body 110, each having a reduced diameter portion terminated by a front wall within an enlarged diameter forward portion and a rear wall within an enlarged diameter rear portion.

The female contact members 212 are similar to the male contact members 112 in that they each have a barrel section with rear projections and front lances, and a crimp section for attachment to a respective wire. However, the forward mating end of each of the female contact members 212 is formed so as to surround and engage the forward mating end 146 of a respective male contact member 112, as is conventional, and is recessed within its respective bore 218 behind the front mating wall 222.

The abutment 214 is formed unitarily with the receptacle body 210 to extend radially outward from the forward portion of the receptacle body 210. This is accomplished by molding the body 210 with a longitudinal exterior channel 226 and forming the abutment 214 within the channel 226 so that the abutment 214 is contained entirely within the confines of a circle which defines the substantially cylindrical shape of the body 210, as best shown in FIG. 5. The abutment 214 has a rear wall 228 which is adapted for interfering engagement with the rear engagement wall 162 of the latch member 114 when the receptacle body 210 is fully seated in the forward mating portion 116 of the plug body 110. The abutment 214 further has a forward camming surface 230 which cooperates with the forward camming surface 164 of the latch member 114.

To matingly engage the plug and receptacle subassemblies, the hollow forward end of the receptacle body 210 is inserted into the forward mating portion 116 of the plug body 110, with the ribs 168 aligned with respective ones of the grooves 224. The abutment 214 is then within the gap 122. Moving the receptacle body 210 forwardly causes engagement of the camming surfaces 230 and 164. This raises the projection 160 of the latch member 114 until the rear wall 228 of the abutment 214 passes the rear engagement wall 162 of the latch member 114, at which time the biasing force provided by the pedestal portion 156 causes the projection 160 of the latch member 114 to snap downwardly to interfere with subsequent separation of the plug and receptacle subassemblies. If it is desired to cause such separation, the handle portion 166 of the latch member 114 is pushed downwardly to move the projection 160 of the latch member 114 upwardly and out of interfering engagement with the abutment 214.

As shown in FIG. 2, the forward ends of the ribs 168 extend forwardly of face 132 and are recessed a short distance within the hollow forward mating portion 116 of the plug body 110. This provides a number of advantages. The forward portion of receptacle body 210 can be rotated within the leading end of forward mating portion 116 of plug body 110 until ribs 168 are received in corresponding grooves 124 before the corresponding contact members 112, 212 are mated to each other. Thus, the plug and receptacle subassemblies are partially mated before polarization. This aids an installer, especially one who may have difficulty with handling and seeing the plug and receptacle subassemblies at the same time because they are too high. Also, such partial mating before polarization prevents damage to the contacts.

The aforedescribed design meets a number of requirements set by the refrigerator manufacturer. One such requirement is that one half of the connector system (i.e., either the plug or the receptacle) must fit through the hollow hinge pin of the refrigerator door. The inner diameter of this hinge pin is less than ½ inch. According to the aforedescribed design, the outer diameter of the receptacle body 210 meets this requirement, since the abutment 214 is maintained within this diameter. The manufacturer also set forth a "creep and clearance" requirement of 2 mm contact separation. This is more than achieved with the aforedescribed design. The arrangement of the contact receiving bores allows the wall thickness required for molding to be maintained. It is usual to provide support for wire insulation by crimping the insulation to the contact. Due to the size requirements of this assembly, such a crimp could not be accommodated. Therefore, the depth of the contact receiving bores in their enlarged diameter rear portions is sufficient to support the insulation.

Accordingly, there has been disclosed an improved electrical connector assembly which is particularly suitable for a refrigerator door. While an exemplary embodiment of the present invention has been disclosed herein, it is understood that various modifications and adaptations to the disclosed embodiment will be apparent to those of ordinary skill in the art and it is intended that this invention be limited only by the scope of the appended claims.

What is claimed is:

1. An electrical connector assembly comprising:

a plug subassembly including:

an insulative plug body having a hollow forward mating portion bounded by a cylindrical wall defining a longitudinal plug axis and subtending an arc greater than 180° and less than 360° to provide a gap in said cylindrical wall, the plug body further having a contact receiving portion rearwardly of said gap, said contact receiving portion being a substantially solid partial cylinder coextensive with said cylindrical wall and subtending an arc greater than 180° and less than the arc subtended by the cylindrical wall to provide a planar surface rearwardly of said gap and angularly symmetrical about said axis with respect to said gap, said contact receiving portion being formed with at least one contact receiving bore extending longitudinally therethrough from a rear wall to a front mating wall defining the rear of said forward mating portion;

at least one conductive male contact member received in a respective one of said at least one contact receiving bore and having a forward mating end extending beyond said front mating wall into said forward mating portion; and a latch member mounted to said planar surface and pivotable about a pivot axis orthogonal to said plug axis, said latch member having a forward end with a rear engagement wall extending into said gap; and a receptacle subassembly including:

an insulative receptacle body having a substantially cylindrical shape defining a longitudinal receptacle axis and sized so that a forward portion fits within said forward mating portion of said plug body with the receptacle axis being parallel to the plug axis, said receptacle body being formed with at least one contact receiving bore extending longitudinally therethrough from a rear wall to a front mating wall and aligned with a respective one of said plug body at least one contact receiving bore when said receptacle body is received in said plug body forward mating portion;

at least one conductive female contact member received in a respective one of said receptacle body at least one contact receiving bore and having a forward mating end adapted for mating engagement with the forward mating end of a respective plug male contact member, the forward mating end of said at least one female contact member being recessed within its respective bore behind said receptacle front mating wall; and an abutment extending radially outward from said receptacle body forward portion, said abutment extending into said gap when said receptacle body forward portion is received in said plug body forward mating portion, said abutment having a rear wall adapted for interfering engagement with the rear engagement wall of said plug latch member when said receptacle body forward portion is fully seated in said plug body forward mating portion.

2. The assembly according to claim 1 wherein said latch member is formed unitarily with said plug body and includes a pedestal portion extending radially outward from said surface to provide said pivot axis, said latch member forward end being cantilevered forwardly from the distal end of said pedestal portion, said pedestal portion providing a yieldable biasing force to said latch member forward end to maintain the latch member rear engagement wall in interfering engagement with said receptacle abutment rear wall.

3. The assembly according to claim 2 wherein said latch member forward end and said abutment both include cooperating forward camming surfaces so that when said receptacle body forward portion is inserted in said plug body forward mating portion the forward camming surface of said abutment engages the forward camming surface of said latch member to move the forward end of said latch member radially outward beyond said abutment until said abutment rear wall passes said latch member rear engagement wall, at which time said latch member forward end snaps downwardly to interfere with subsequent separation of the plug and receptacle subassemblies.

4. The assembly according to claim 3 wherein said latch member further includes a handle portion cantilevered rearwardly from the distal end of said pedestal portion, whereby a downward force applied to said handle portion results in the latch member forward end being moved upwardly to disengage from the abutment and allow separation of the plug and receptacle subassemblies.

5. The assembly according to claim 1 wherein said plug body cylindrical wall is formed with at least one raised longitudinal rib within said hollow forward mating portion and said receptacle body forward portion is formed with at least one longitudinal groove complemental to said at least one rib and extending rearwardly from said receptacle body front mating wall, there being an equal number of ribs and grooves, the at least one rib and at least one groove being angularly located to provide a polarizing feature for the mating of the plug and receptacle subassemblies.

6. The assembly according to claim 5 wherein the forward end of said at least one rib is recessed within said hollow forward mating portion, whereby the plug and receptacle subassemblies are partially mated before polarization.

7. The assembly according to claim 1 wherein:

each of said contact members includes a cylindrical barrel section, an outwardly extending projection at the rear of the barrel section, and an outwardly extending locking lance at the forward end of the barrel section; and each of said contact receiving bores includes a central reduced diameter portion sized to accept said barrel section therein and terminated by a front wall within an enlarged diameter forward portion and a rear wall within an enlarged diameter rear portion, the length of said central reduced diameter portion being less than the distance between the rear end of said lance and the forward end of said projection;

whereby when a contact member is installed in a respective contact receiving bore, the lance is compressed as it passes through the central reduced diameter portion and then snaps outwardly to interfere with subsequent rearward removal of the contact member from the bore, and the projection is in interfering relation with the rear wall to interfere with further forward movement of the contact member, thereby capturing the contact member in the bore.

8. The assembly according to claim 1 wherein said abutment is contained entirely within the confines of a circle which defines the substantially cylindrical shape of said receptacle body, when viewed in a plane orthogonal to said receptacle axis.

9. An electrical connector subassembly comprising:

an insulative body having a hollow forward mating portion bounded by a cylindrical wall defining a longitudinal axis, the body further having a contact receiving portion which is substantially solid and coextensive with at least part of said cylindrical wall, said contact receiving portion being formed with at least one contact receiving bore extending longitudinally therethrough from a rear wall to a front mating wall defining the rear of said forward mating portion;

at least one conductive contact member received in a respective one of said at least one contact receiving bore of said body and having a forward mating end extending beyond said front mating wall into said hollow forward mating portion; and at least one raised longitudinal rib within said hollow forward mating portion to provide a polarizing feature in cooperation with a complemental groove on the exterior of an insulative body of a complemental mating connector subassembly received in said hollow forward mating portion, the forward end of said at least one rib being recessed within said hollow forward mating portion whereby said insulative bodies of said complemental mating connector subassemblies are partially mated before polarization and subsequent mating of complemental contact members within said subassemblies.

* * * * *